US012290733B2

(12) United States Patent
Brown

(10) Patent No.: US 12,290,733 B2
(45) Date of Patent: May 6, 2025

(54) SLOW PITCH SOFTBALL PITCHING MACHINE

(71) Applicant: Strokes Equipment, LLC, Allen, TX (US)

(72) Inventor: Jannsen Brown, Allen, TX (US)

(73) Assignee: Strokes Equipment, LLC, Allen, TX (US)

( * ) Notice: Subject to any disclaimer, the term of this patent is extended or adjusted under 35 U.S.C. 154(b) by 155 days.

(21) Appl. No.: 17/966,208

(22) Filed: Oct. 14, 2022

(65) Prior Publication Data

US 2023/0117849 A1 Apr. 20, 2023

Related U.S. Application Data

(60) Provisional application No. 63/256,021, filed on Oct. 15, 2021.

(51) Int. Cl.
*A63B 69/00* (2006.01)
*A63B 69/40* (2006.01)
*A63B 102/18* (2015.01)

(52) U.S. Cl.
CPC ..... *A63B 69/407* (2013.01); *A63B 69/0002* (2013.01); *A63B 2069/0008* (2013.01); *A63B 2102/182* (2015.10); *A63B 2220/80* (2013.01)

(58) Field of Classification Search
CPC ..... A63B 69/407; A63B 69/0002; A63B 2069/0008; A63B 2102/182; A63B 2220/80; A63B 2225/74; A63B 2069/401; A63B 2069/402; A63B 2071/025; A63B 2210/50; A63B 2225/50
USPC ..... 473/422, 451; 124/6, 7, 41.1, 81
See application file for complete search history.

(56) References Cited

U.S. PATENT DOCUMENTS

| | | | | |
|---|---|---|---|---|
| 7,691,012 | B2 * | 4/2010 | Cucjen | A63B 69/406 124/78 |
| 7,806,788 | B1 * | 10/2010 | Neuman | A63B 69/408 124/78 |
| 9,010,309 | B2 * | 4/2015 | Lewis | A63B 69/40 124/78 |
| 9,981,174 | B1 * | 5/2018 | Decilveo | A63B 47/002 |
| 10,166,456 | B1 * | 1/2019 | Decilveo | A63B 69/0002 |
| 2001/0013690 | A1 * | 8/2001 | Sexton | B62B 3/108 280/33.991 |
| 2008/0184979 | A1 * | 8/2008 | Estalella | A63B 69/407 124/16 |
| 2010/0242317 | A1 * | 9/2010 | Trowsdale | D06F 81/04 38/103 |
| 2016/0031464 | A1 * | 2/2016 | Bruno | B62B 1/22 248/205.1 |

* cited by examiner

*Primary Examiner* — Nini F Legesse
(74) *Attorney, Agent, or Firm* — Barnes & Thornburg

(57) ABSTRACT

A softball pitching machine in accordance with the present disclosure is configured to lob a softball along an arcuate path with forward spin to mimic the motion of an underhand, slow pitched softball from a human pitcher. The softball pitching machine includes a throwing arm having a curved hand configured to move along a predetermined arcuate path to a preset stopping point that imparts the arcing path and the forward spin on the softball.

20 Claims, 10 Drawing Sheets

SLOW PITCH SOFTBALL PITCHING MACHINE

PRIORITY CLAIM

This application claims priority under 35 U.S.C. § 119(e) to U.S. Provisional Application Ser. No. 63/256,021, filed Oct. 15, 2021, which is expressly incorporated by reference herein.

FIELD OF THE DISCLOSURE

The present disclosure relates generally to pitching machines, and more specifically to pitching machines adapted for use in slow pitch softball.

BACKGROUND

Slow pitch softball is a sport similar to baseball but played with a larger ball that is lobbed underhand along an arcing path rather than thrown at high speed. A slow pitch softball pitch is typically required to rise above a batters head and to bounce on the ground within a preset distance behind home plate. The relative ease of hitting a slow pitch softball compared to either a fast pitched softball or baseball makes the sport enjoyable for a wide range of players.

Adult recreational and travelling leagues for slow pitch softball have grown in popularity leading to many players practicing slow pitch hitting skills. Practicing slow pitch softball hitting requires a partner to deliver lobbed pitches or modification of pitching machines designed for fast pitch hitting in an effort to mimic the slow, arcing path of slow pitch softball play. However, it is not always possible to find a partner with experience or a machine that can be successfully modified. Accordingly, there is a need for a pitching machine adapted for use in slow pitch softball practice.

SUMMARY

The present disclosure may comprise one or more of the following features and combinations thereof.

A softball pitching machine in accordance with the present disclosure is configured to lob softballs to a batter. The softball pitching machine may include a base, a ball ramp assembly that presents softballs to be discharged from the machine, and a ball launcher that accelerates softballs presented by the ball ramp assembly along an arcing path to a batter.

In exemplary embodiments, the ball launcher is configured to lob a softball along an arcuate path with forward spin to mimic the motion of an underhand, slow pitched softball from a human pitcher. The softball pitching machine can include a throwing arm having a curved hand configured to move along a predetermined arcuate path to a preset stopping point that imparts the arcing path and the forward spin on the softball.

In exemplary embodiments, the base of the softball pitching machine is movable from an expanded configuration for use to a collapsed configuration for transport or storage. In the expanded configuration, the legs extend downwardly from an underside of the ball launcher to enable use of the pitching machine. In the collapsed configuration, the legs extend along the underside of the ball launcher for transport and storage of the pitching machine.

In exemplary embodiments, the ball ramp assembly includes a hopper for holding a number of softballs, a ball rail for holding a single softball to be lobbed, and a ball gate that selectively allows movement of a softball from the hopper to the ball rail. The ball gate can be activated by a user input or timer so that a batter or defending team can control the discharge of softballs.

In exemplary embodiments, user inputs can come from a foot pedal input or a home plate input spaced apart from the ball launcher. These inputs can be configured to receive signals from a foot press or a bat tap by a batter using the softball pitching machine. Of course, other user inputs both at and spaced apart from the ball launcher may be used.

These and other features of the present disclosure will become more apparent from the following description of the illustrative embodiments.

BRIEF DESCRIPTION OF THE DRAWINGS

FIG. 15 is a side elevation view of the machine in a use mode with the legs of the base in an expanded configuration with a wheel stop in an anchored position and with the ball rail in a use position;

FIG. 16 is a side elevation view of the machine in the storage mode with the wheel stop rotated to a disengaged position and the ball rail in a stowed position;

FIG. 17 is a side elevation view of the machine with the legs of the base in a collapsed configuration;

FIG. 18 is a side elevation view of the machine in the transport mode with the legs of the base in a collapsed configuration providing a handle for pulling the machine from location to location.

DETAILED DESCRIPTION OF THE DRAWINGS

Figure 1:
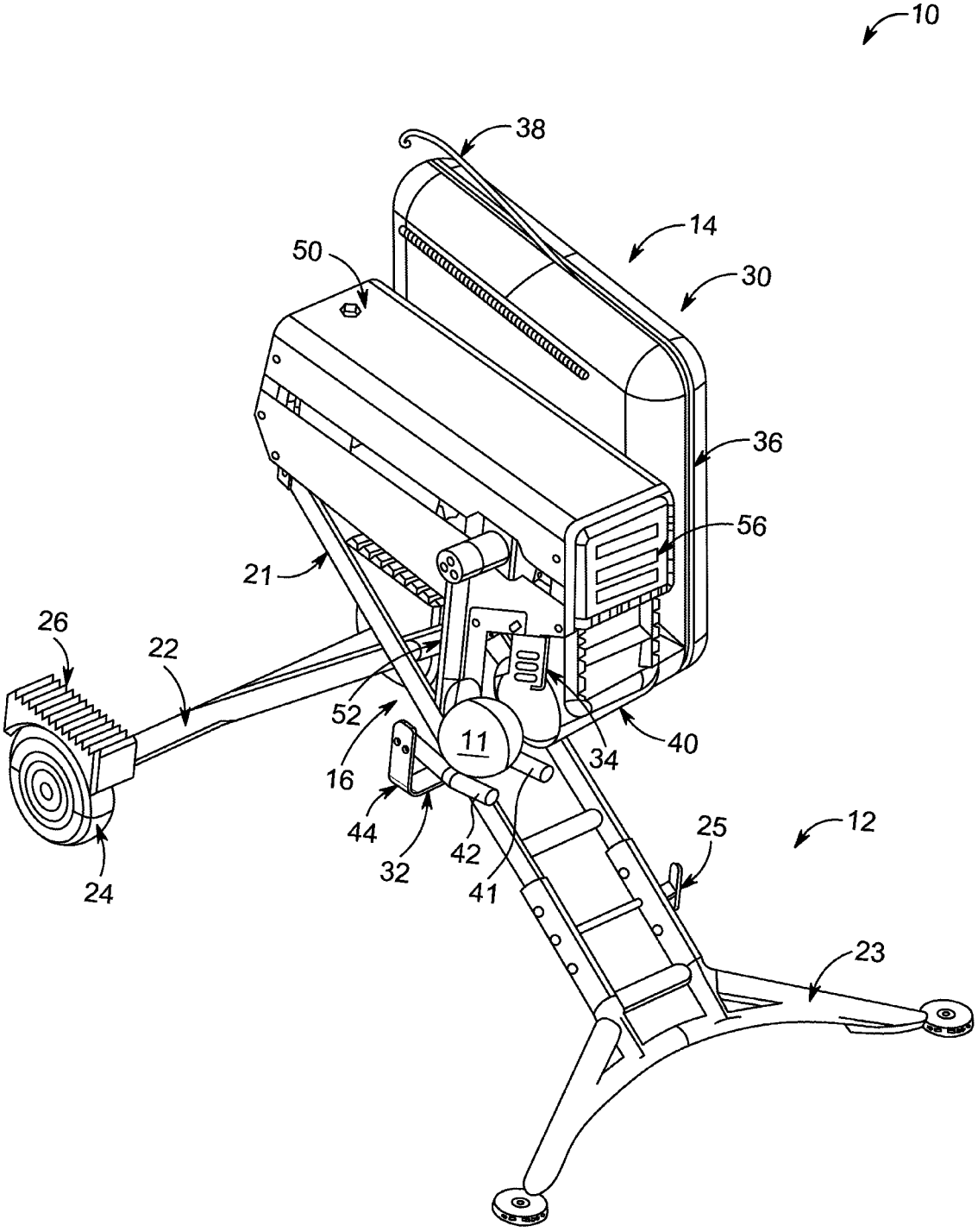
FIG. 1 is a perspective view of a slow pitch softball pitching machine showing that the machine includes a base with legs, a ball ramp assembly that stores and presents softballs to be discharged from the machine, and a ball launcher that lobs softballs presented by the ball ramp assembly along an arcing path to a batter.

For the purposes of promoting an understanding of the principles of the disclosure, reference will now be made to a number of illustrative embodiments illustrated in the drawings and specific language will be used to describe the same.

Figure 6:
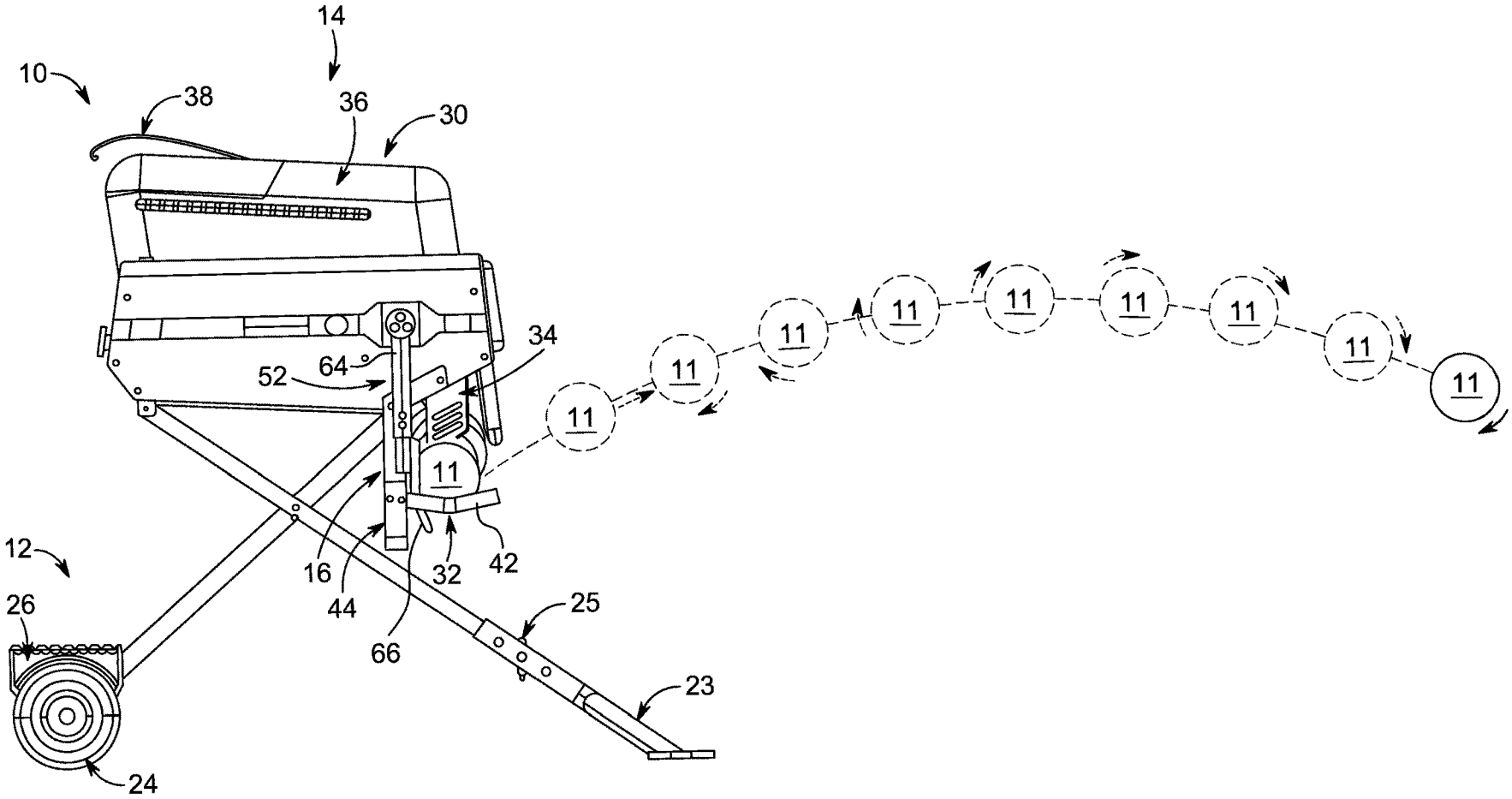
FIG. 6 is another side elevation view of the machine in FIGS. 1-5 showing a ball discharged from the machine by the throwing arm along an arcuate path and having a forward spin mimicking the typical spin of a ball pitched underhand by a human pitcher.

A slow pitch softball pitching machine 10, shown in FIG. 1, is configured to discharge softballs 11 along an arcuate path similar to the path taken by a softball that is slow pitched by a human pitcher as suggested in FIG. 6. The machine 10 includes a base 12, a ball ramp assembly 14, and a ball launcher 16. The base 12 has legs 21, 22 that support the ball launcher 16 at a preset height selected to mimic the discharge height of a human pitcher lobbing a softball pitch. The ball ramp assembly 14 stores and presents softballs 11 to be discharged from the machine 10 by the ball launcher 16.

Figures 15, 16:
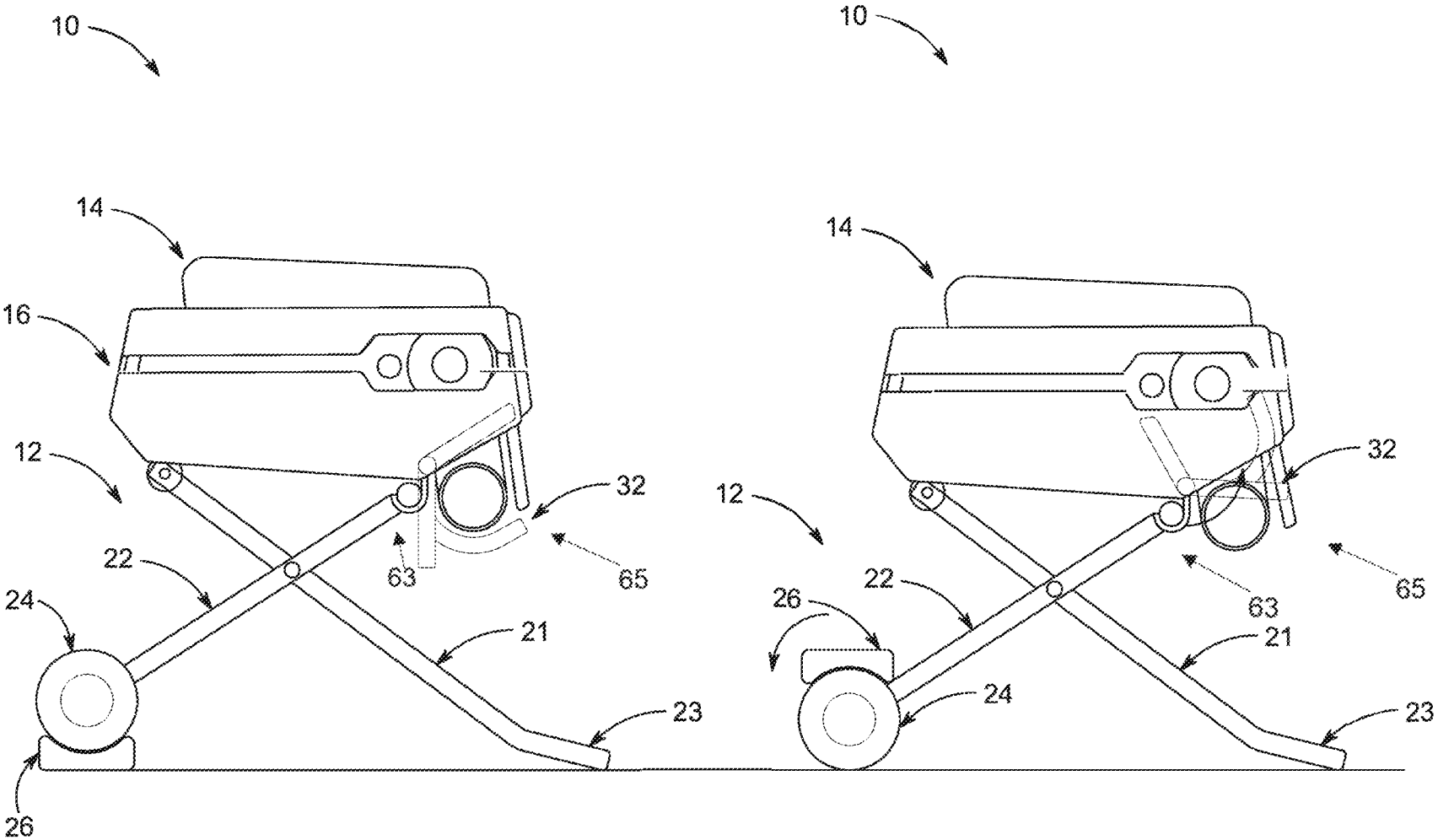
FIGS. 15-18 are a series of views showing reconfiguration of the slow pitch softball pitching machine from a use mode, to a storage mode, and to a transport mode.
Figure 18:
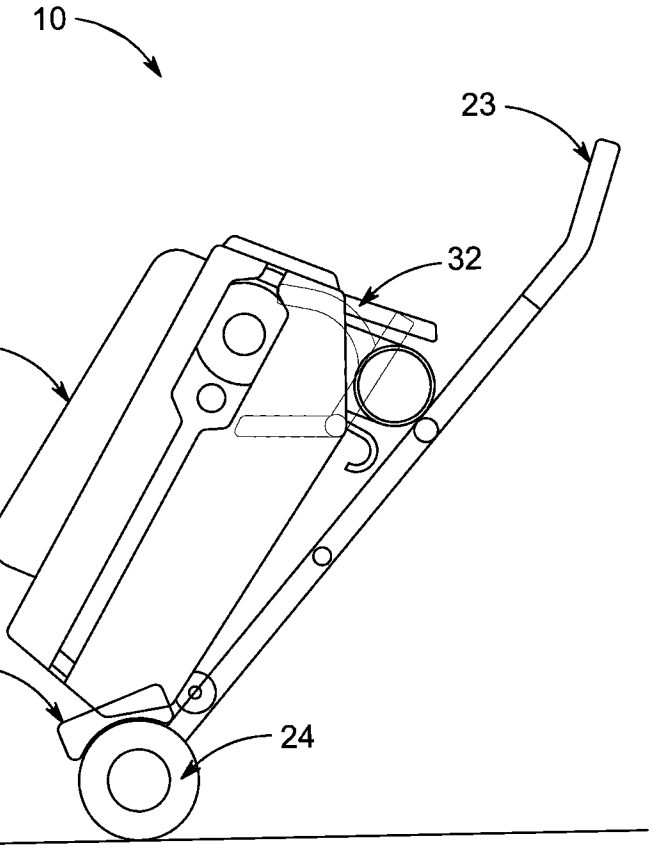
Figure 17:
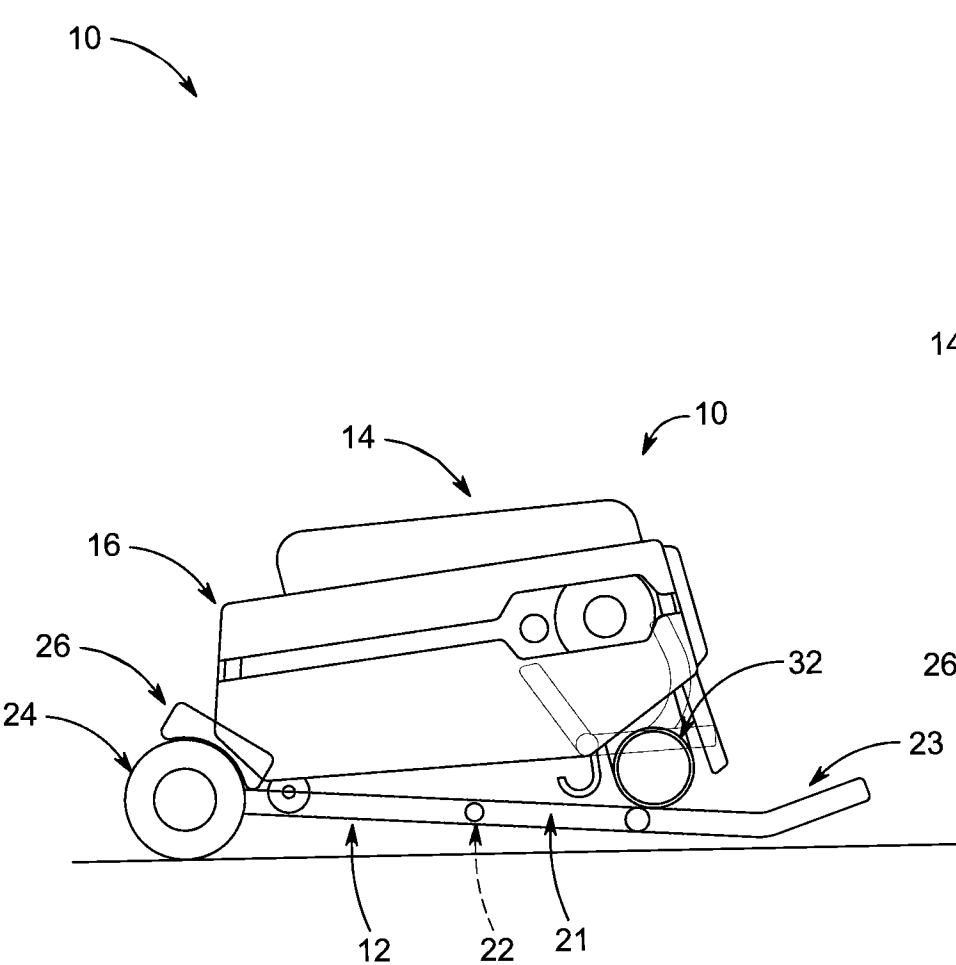

The base 12 has legs 21, 22 that move from an expanded configuration, shown in FIG. 15, to a collapsed configuration shown in FIG. 18. In the expanded configuration, the legs 21, 22 extend downwardly from an underside of the ball launcher 16 to enable use of the pitching machine 10. In the collapsed configuration, the legs 21, 22 extend along the underside of the ball launcher 16 for transport and storage of the pitching machine 10.

In the illustrated embodiment, rear leg 21 is pivotably coupled at a proximal end to an aft side of the ball launcher 16. The rear leg 21 also has a free distal end that engages the ground underlying the machine 10 in the expanded configuration and that provides a handle that extends away from the ball launcher to provide a handle when the base is in the collapsed configuration. The length of the rear leg 21 can be adjusted using pinned connection 25 that controls telescoping of rear leg foot 23 as suggested in FIGS. 1-3.

The front leg 22 is pivotably coupled near a mid-point of to the rear leg 21. The front leg 22 has a first end that engages a catch 63 at the front 65 of the ball launcher 16 when the legs 21, 22 are in the expanded configuration. The front leg 22 also has a second end fitted illustratively with a wheel 24 for rolling support of the machine 10 in the collapsed configuration and a wheel stop 26 that can be positioned in an anchored position to fix the front leg 22 when in the expanded configuration.

Figure 2:
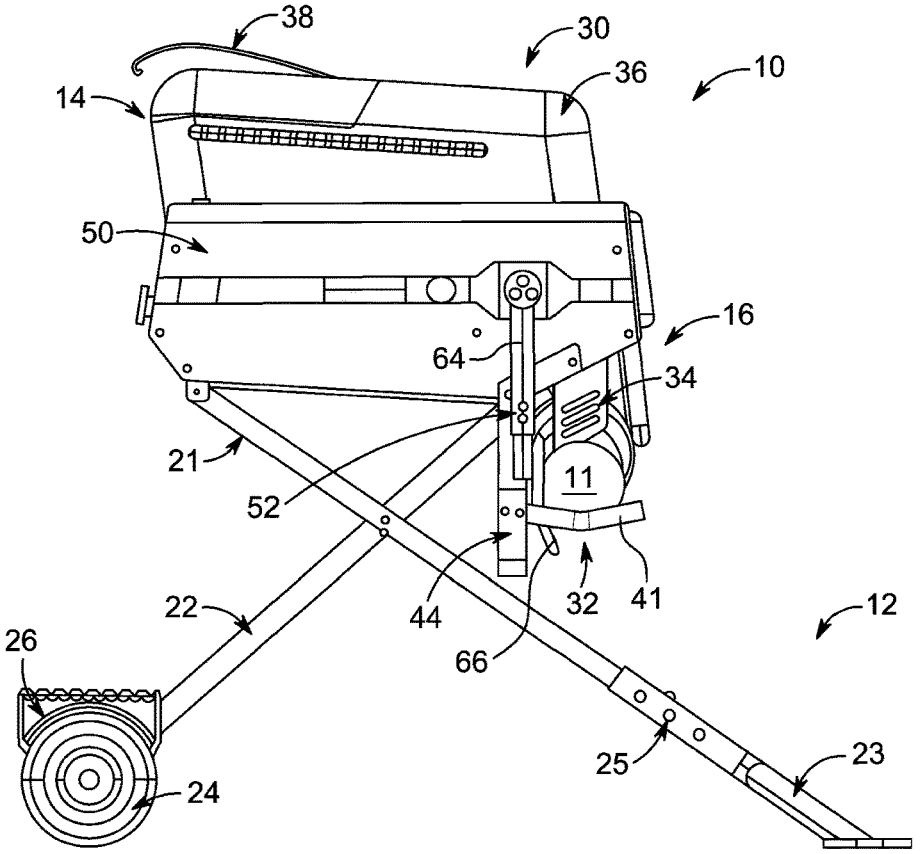
FIG. 2 is a first side elevation view of the machine in FIG. 1 showing that the ball launcher includes a housing containing a drive mechanism as well as a throwing arm outside the housing coupled to the drive mechanism, and showing that the ball ramp assembly includes a hopper mounted to the housing of the ball launcher, a ball rail that supports a ball prior to discharge from the machine, and an automated ball gate that selectively allows balls from the hopper to move onto the ball rail.
Figure 3:
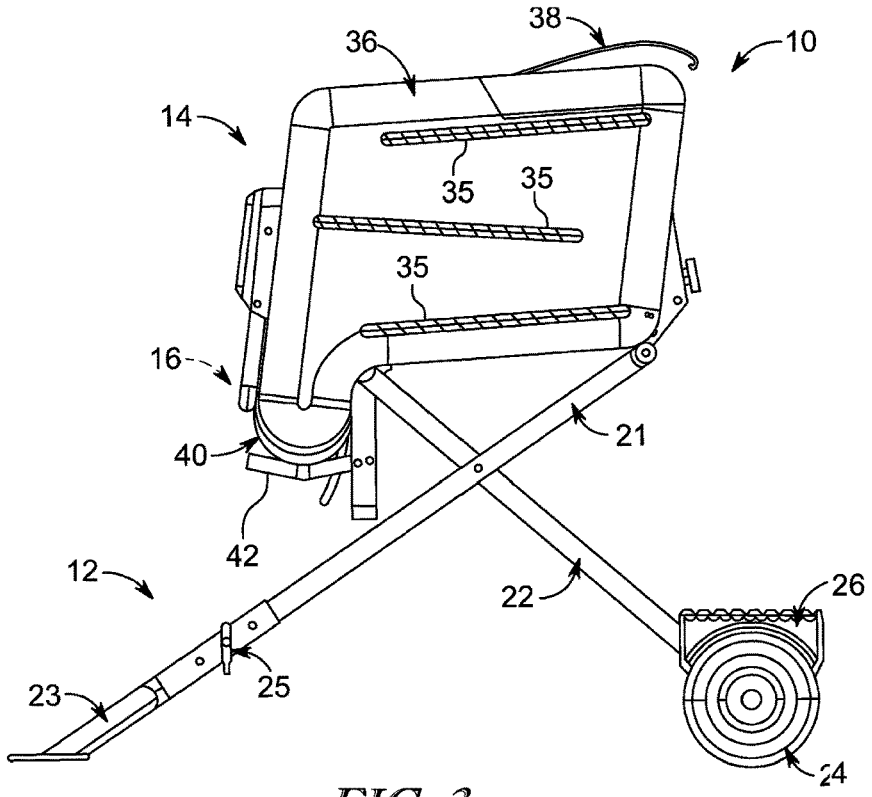
FIG. 3 is a second side elevation view of the machine in FIGS. 1 and 2 showing that the hopper of the ball ramp assembly is shaped to define pre-set travel lanes through the hopper so as to guide balls in sequence to the ball gate, maximize the number of balls stored, and to avoid clogging of the hopper during use of the machine.

The ball ramp assembly 14 includes a hopper 30, a ball rail 32, and a ball gate 34 as shown in FIG. 2. The hopper 30 stores softballs to be presented to the ball launcher 16. The ball rail 32 holds a single softball 11 in position for a throwing arm 52 of the ball launcher 16 to scoop the softball 11 and lob it to a waiting batter. The ball gate 34 selectively allows balls 11 from the hopper 30 to move onto the ball rail 32. In illustrative embodiments, the ball gate 34 can be remotely controlled, controlled on a timer, controlled based on throwing arm 52 position, or otherwise opened as needed to allow softballs 11 to be fed one at a time onto the ball rail 32. In other embodiments, the ball gate 34 can be provided by a wheel that selectively engages and moves balls at the exit of the hopper to push them onto the rail 32.

Figure 10:
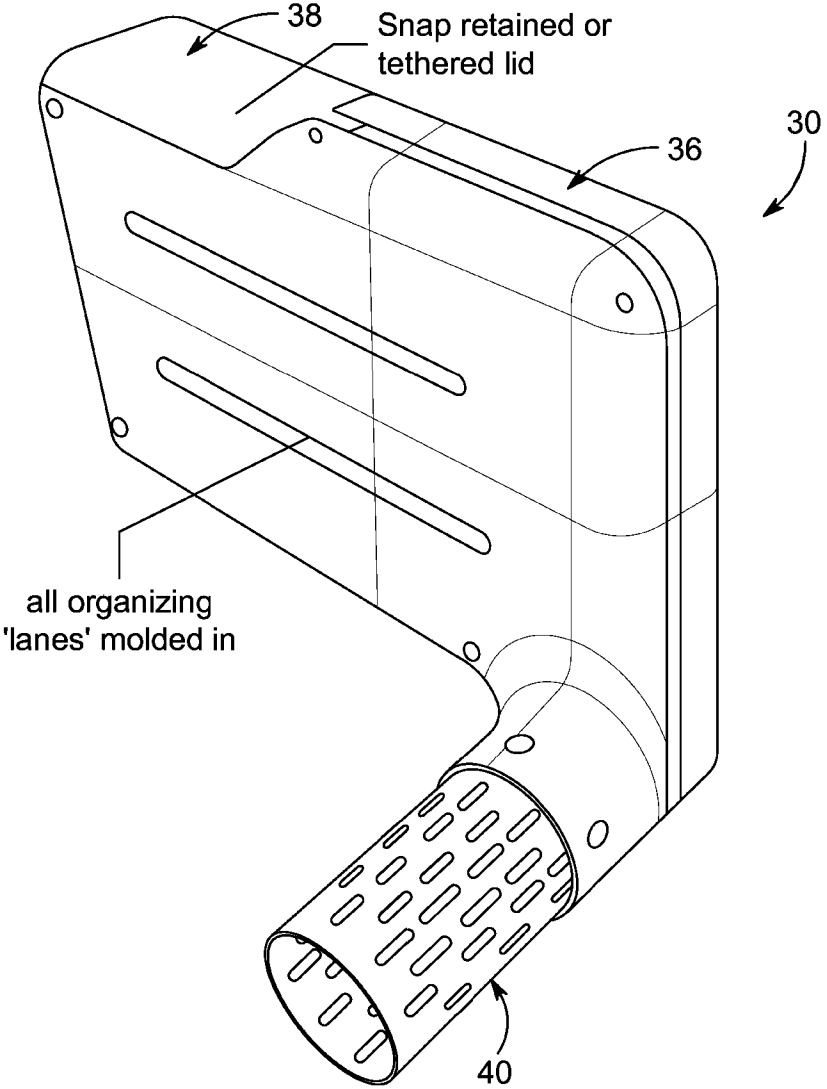
FIG. 10 is a detail perspective view of the hopper showing that the hopper includes a ball-storage bin, a lid coupled to the ball-storage bin to allow for selective access into the bin, and a transfer tube that carries balls from end of the pre-set travel lane at the bottom of the ball-storage bin under the housing of the ball launcher toward the ball rail.

The hopper 30 includes a ball-storage bin 36, a lid 38, and a transfer tube 40 as shown in FIG. 10. The ball-storage bin 36 is shaped to define pre-set travel lanes via ribs 35 through the hopper 30 so as to guide balls in sequence to the ball gate 34. The lid 38 is coupled to the ball-storage bin 36 to allow for selective access into the bin 36. The transfer tube 40 carries balls 11 from an end of the pre-set travel lane at the bottom of the ball-storage bin 36, under a housing 50 of the ball launcher 16 toward the ball rail 32.

Figure 11:
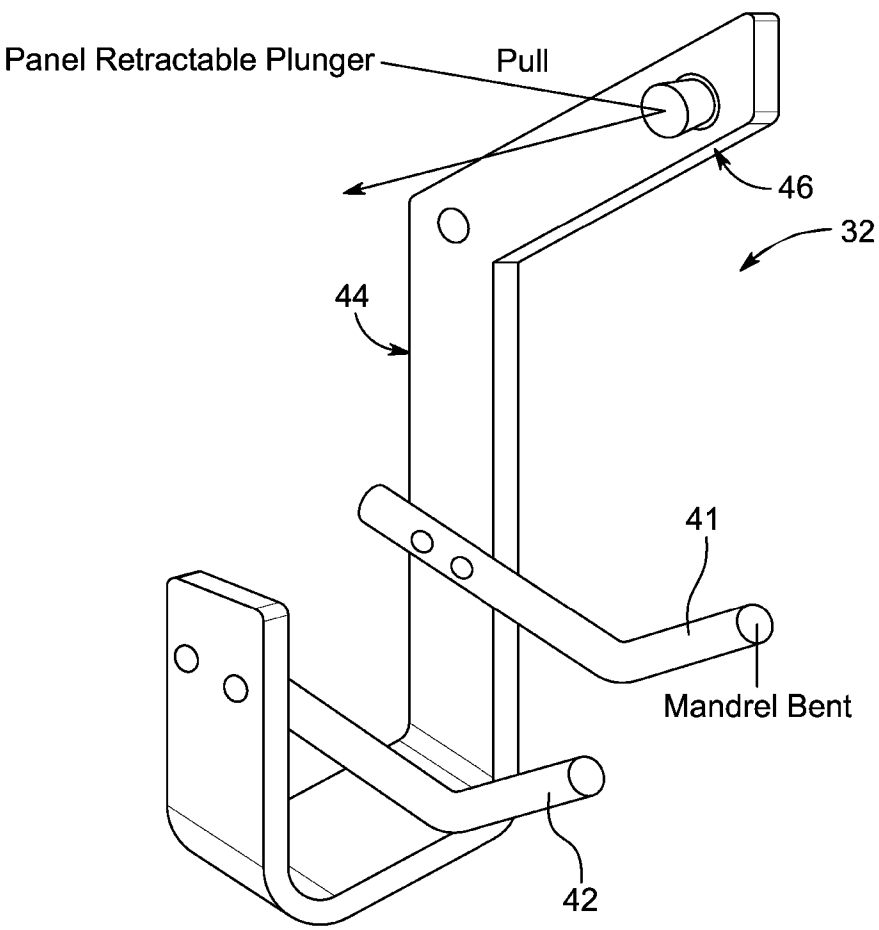
FIG. 11 is a detail perspective view of the ball rail showing that the ball rail includes a mount bracket and a pair of ball support rods bent to locate a ball loaded onto the ball rail for acceleration along an arcuate path, and showing that the mount bracket is configured to be pivotably mounted to the housing of the ball launcher and having a bracket lock provided by a retractable plunger configured to selectively retain the mount bracket (and support rods) in a desired position.

The ball rail 32 illustratively includes a mount bracket 44 and a pair of ball support rods 41, 42 as shown in FIG. 11. The mount bracket 44 is pivotably mounted to the housing 50 of the ball launcher 16 and has a bracket lock 46 provided by a retractable plunger configured to selectively retain the mount bracket 44 (and support rods 41, 42) in a desired position. The ball support rods 41, 42 are bent to locate via gravity a ball 11 loaded onto the ball rail 32 for pitching by the throwing arm 52.

The ball gate 34 is mounted at the end of the transfer tube 40 included in the hopper 30 and moves to block or allow a softball 11 to exit the hopper 30 as suggested in FIG. 1. The ball gate 34 may move from a normally deactivated (closed position) to an activated (opened position) by control signal from on-board controls, remote controls, or timed controls.

The ball launcher 16 includes a housing 50 containing a drive mechanism 54 as well as a throwing arm 52 arranged outside the housing 50 as shown in FIGS. 1-5. The throwing arm 52 launches a softball 11 off of the ball rail 32. The drive mechanism 54 moves the throwing arm 52 along an arc to drive launch of the softball 11.

Figure 4:
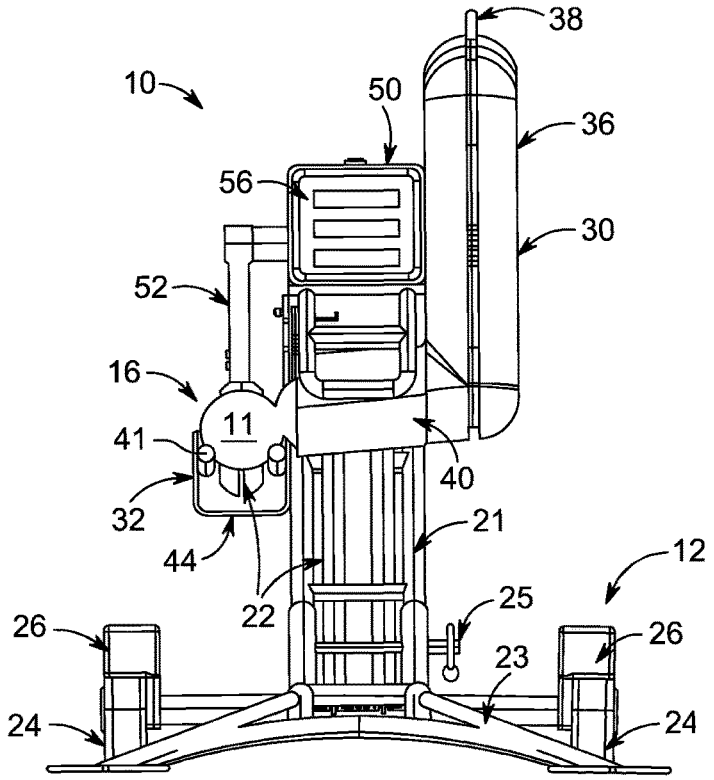
FIG. 4 is a front elevation view of the machine in FIGS. 1-3 showing that the ball launcher further includes indicator lights mounted to the front of the housing so as to alert a batter of an upcoming pitch.
Figure 5:
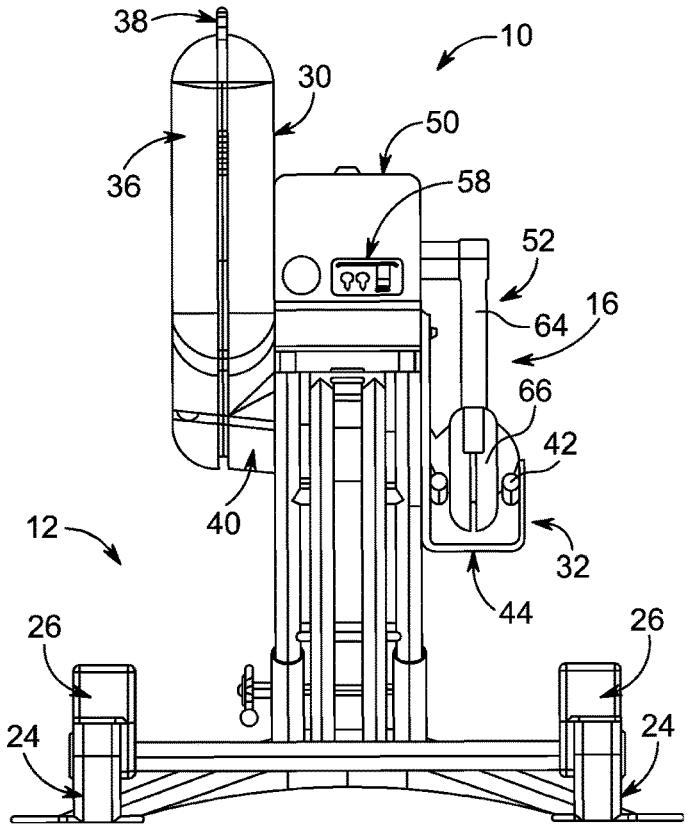
FIG. 5 is a rear elevation view of the machine in FIGS. 1-4 showing that the ball launcher further includes user inputs for controlling operation of the ball launcher.
Figure 12:
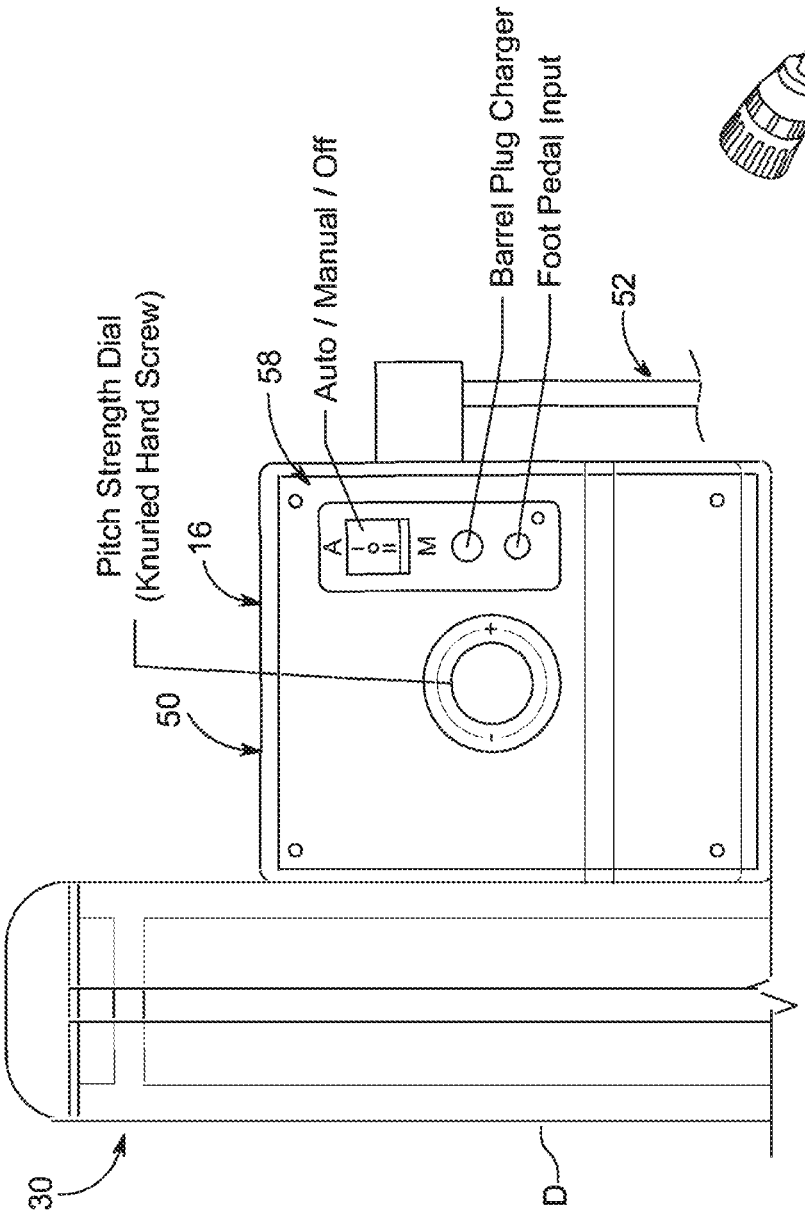
FIG. 12 is a detail view of a portion of the rear side of the ball launcher showing integrated user inputs including a three position off/auto/manual switch, and a pitch strength dial, and further showing connection points for a battery charger and a remote user input.

The housing 50 protects the drive mechanism 54 and supports various user inputs/outputs as suggested in FIGS. 4-5. More specifically, the housing includes indicator lights 56 mounted to the front of the housing 50 so as to alert a batter of an upcoming pitch. The housing 50 also includes user inputs 58 for controlling operation of the ball launcher 16 as shown in FIGS. 5 and 12. The user inputs 58 illustratively include a three position off/auto/manual switch, and a pitch strength dial. The housing 50 also has connection points for a battery charger and a remote user input.

Figure 13:
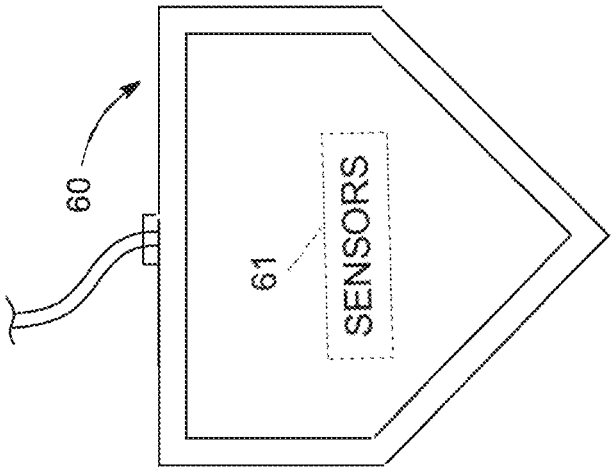
FIG. 13 is a plan view of a home-plate remote user input adapted for communication with the ball launcher via wired or wireless communication showing that the home-plate remote user input is shaped to lie over (or in place of) a home plate and has sensors configured to detect a bat tap or step onto the plate for initiating a ball launch sequence.
Figure 14:
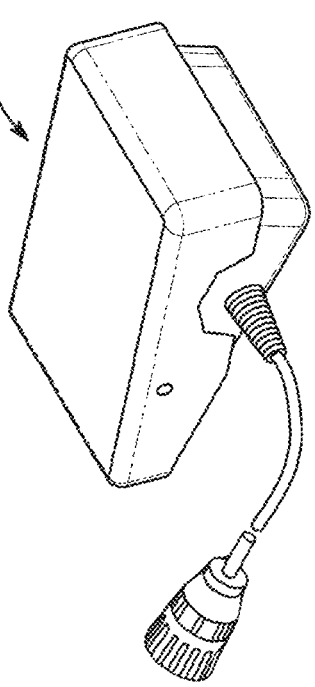
FIG. 14 is a perspective view of a pedal remote user input adapted for communication with the ball launcher via wired or wireless communication suggesting that the pedal remote is configured to detect a bat tap or step onto the pedal for initiating a ball launch sequence.

Remote user inputs can be in the form of a home-plate remote user input 60 or pedal remote 62 adapted for communication with the ball launcher via wired or wireless communication as shown in FIGS. 13 and 14. The home-plate remote user input 60 is shaped to lie over (or in place of) a home plate and has sensors 61 configured to detect a bat tap or step onto the plate for initiating a ball launch sequence. The pedal remote 62 is configured to detect a bat tap or step onto the pedal for initiating a ball launch sequence.

Figure 9:
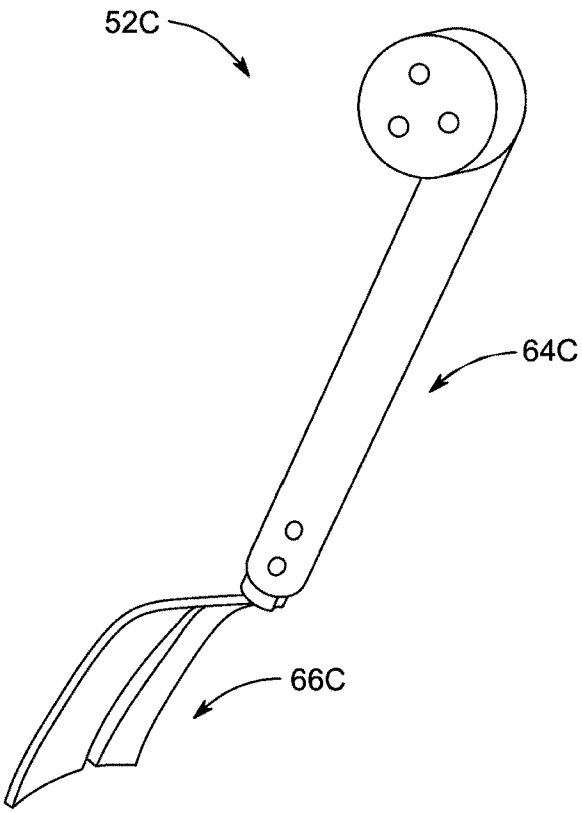
FIG. 9 is a perspective view of a third throwing arm having a round tube extension and a stamped metallic hand shaped to impart forward spin on a ball upon discharge from the machine.
Figure 8:
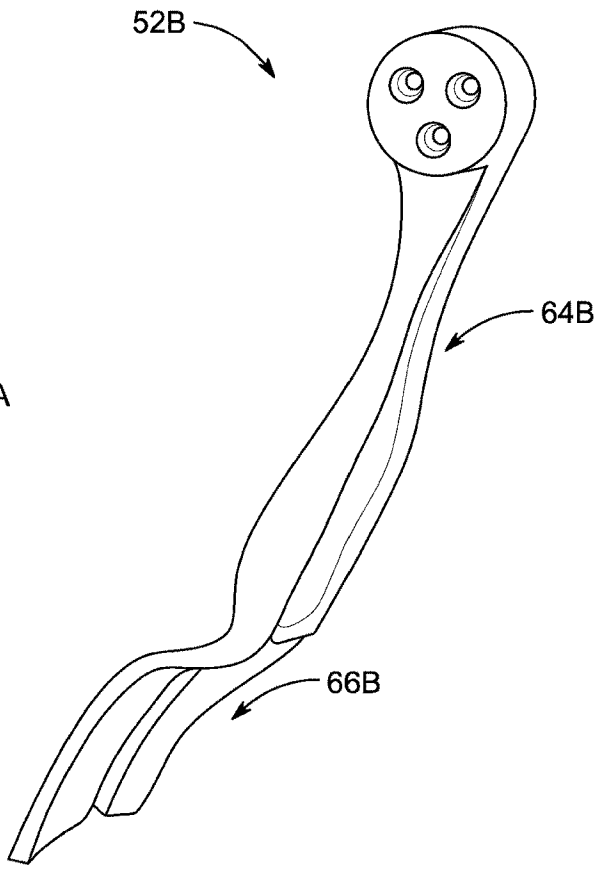
FIG. 8 is a perspective view of a second throwing arm having an integrally molded extension and a hand shaped to impart forward spin on a ball upon discharge from the machine.
Figure 7:
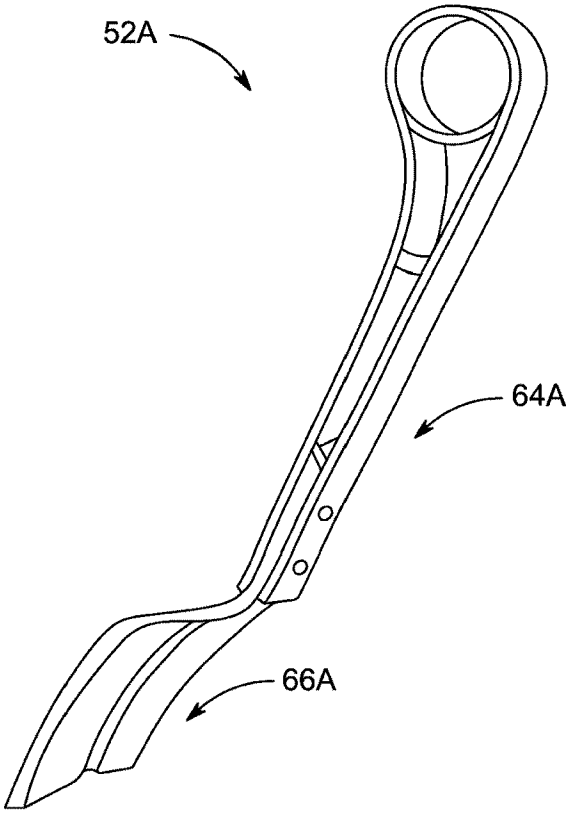
FIG. 7 is a perspective view of a first throwing arm having a bent metallic extension and a molded hand shaped to impart forward spin on a ball upon discharge from the machine.

The throwing arm 52 has an extension 64 that extends from the drive mechanism 54 and a molded hand 66 shaped to impart forward spin on a ball upon discharge from the machine as shown in FIG. 1. In illustrative embodiments, the throwing arm may have a bent metallic extension 64A and a molded hand 66A as shown in FIG. 7. According to another embodiment, the throwing arm 52 may have an integrally molded extension 64B and a hand 66B as shown in FIG. 8. In yet another embodiment, the throwing arm 52 may have a round tube extension 64C and a stamped metallic hand 66C as shown in FIG. 9.

Figure 19:
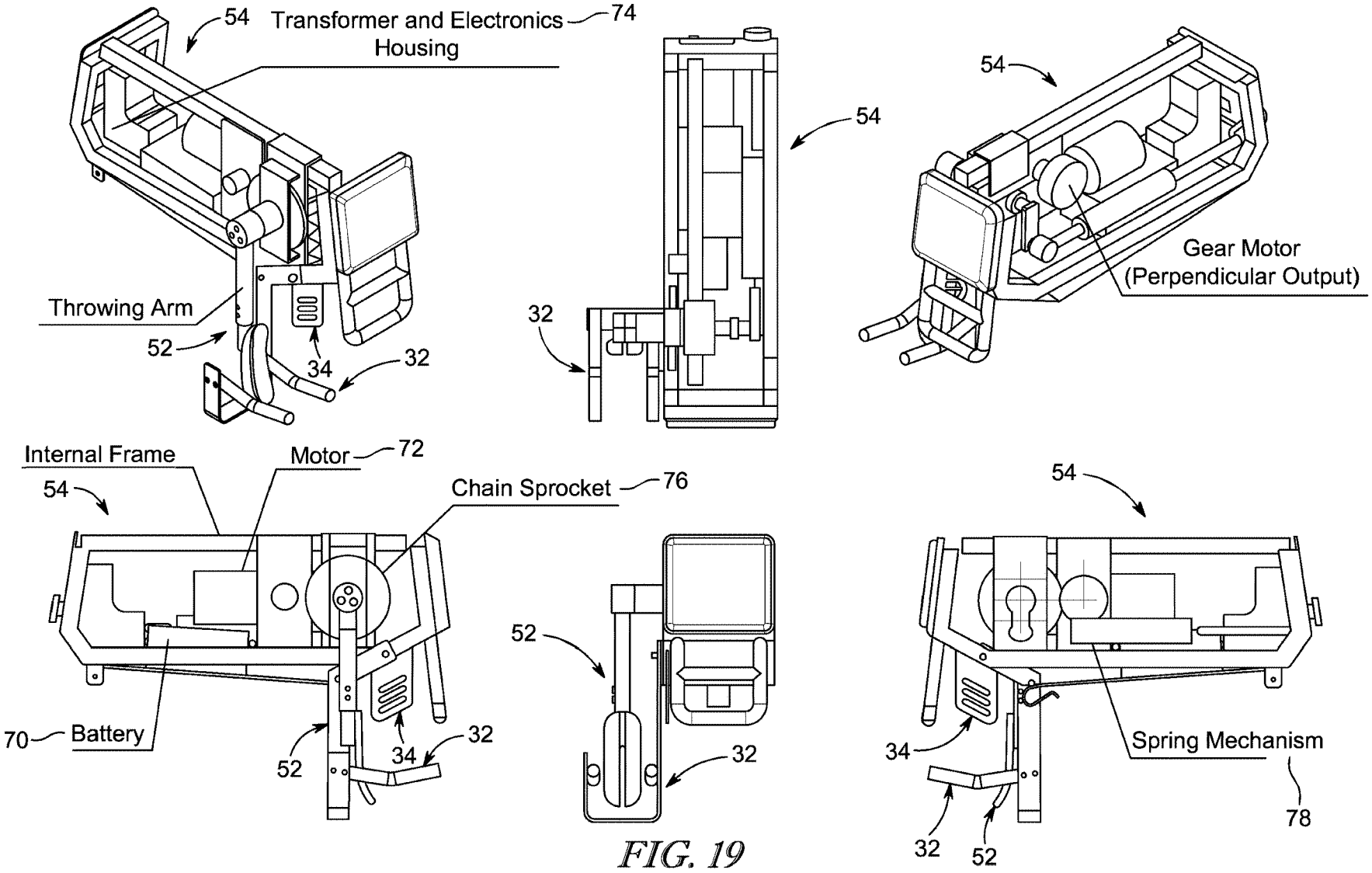
FIG. 19 is a series of views of the ball launcher with the housing removed to show that the drive mechanism for the throwing arm includes a battery, a motor, and a spring mechanism configured to drive arcuate rotation of the arm to pitch a softball at pre-selected speeds.

Turning now to the drive mechanism 54, one specific implementation of a powered drive for moving the throwing arm 52 along the pitching arc is shown in the various views of FIG. 19. In this implementation, the drive mechanism 54 includes a battery 70, a motor 72, and control electronics 74 in a housing with a transformer element. The battery 70 stores on board power. The motor 72 is coupled to the battery via the control electronics 74 and drives a chain sprocket 76 coupled to the throwing arm 52.

A spring mechanism 78 is also coupled to the throwing arm 52 to control forward motion of the throwing arm 52 and to return the throwing arm 52 to its starting position. More specifically, the spring mechanism 78 cooperates with a chain and cam assembly (not shown) between the motor 72 and the pitching arm with the spring 78 acting as the force component. The motor/chain/cam rotates loads the spring 78. The energy of the spring 78 is released when the cam reaches a particular point in the rotation. This process repeats automatically in auto mode and in manual mode, the cam (and arm) are returned to starting position prior to each activation.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A softball pitching machine for lobbing softballs to a batter, the pitching machine comprising a base adapted to engage ground underlying the pitching machine, a ball ramp assembly supported above the ground by the base that stores and presents softballs to be discharged from the pitching machine, and a ball launcher configured to lob softballs presented on the ball ramp assembly along an arcing path with a forward spin mimicking the spin of a softball pitched underhand by a human pitcher to a batter, the ball launcher including a throwing arm having an extension and a curved hand configured to move along a predetermined arcuate path, wherein the ball ramp assembly includes a ball rail configured to support a single softball in position for the curved hand of the throwing arm to engage and discharge the softball from the pitching machine during movement of the throwing arm along the predetermined arcuate path, and wherein the ball rail includes ball support rods that are spaced apart to allow the curved hand to pass through the space during movement of the throwing arm along the predetermined arcuate path.

2. The pitching machine of claim 1, wherein the base includes legs that move from an expanded configuration extending downwardly from an underside of the ball launcher during use of the pitching machine to a collapsed configuration extending along the underside of the ball launcher during transport and storage of the pitching machine.

3. The pitching machine of claim 2, wherein a rear leg of the base has a proximal end pivotably coupled to an aft side of the ball launcher and a front leg of the base has pivotably coupled to the rear leg near a mid-point the rear leg.

4. The pitching machine of claim 3, wherein the front leg of the base has a first end that engages a catch at a front of the ball launcher when the base is in the expanded configuration.

5. The pitching machine of claim 4, wherein the front leg has a second end fitted with a wheel for rolling support of the pitching machine when the base is in the collapsed configuration.

6. The pitching machine of claim 5, wherein the front leg has a wheel stop that can be positioned in an anchored position to fix the front leg when the base is in the expanded configuration.

7. The pitching machine of claim 3, wherein the rear leg has a free distal end that engages the ground underlying the pitching machine when the base is in the expanded configuration and that extends away from the ball launcher to provide a handle when the base is in the collapsed configuration.

8. The pitching machine of claim 1, wherein the ball support rods are bent to locate via gravity the single softball supported on the ball rail.

9. The pitching machine of claim 1, wherein the ball ramp assembly includes a hopper configured to store a plurality softballs prior to discharge from the softball pitching machine.

10. The pitching machine of claim 9, wherein the ball ramp assembly includes a ball gate configured to selectively allow a softball to pass from the hopper to the ball rail for engagement by the ball launcher.

11. The pitching machine of claim 10, wherein the ball gate is configured to be moved from a normally closed position to an opened position allowing a softball to pass from the hopper to the ball rail for engagement by the ball launcher in response to receipt of a signal from a remote user input.

12. The pitching machine of claim 1, wherein the ball launcher includes a drive mechanism coupled to the throwing arm and configured to drive motion of the throwing arm.

13. The pitching machine of claim 12, wherein the drive mechanism includes a motor drivingly coupled to the throwing arm to drive movement of the curved hand along the predetermined arcuate path.

14. The pitching machine of claim 13, wherein the drive mechanism includes a spring coupled to the throwing arm and configured to resist forward motion of the throwing arm and contribute to the preset stopping point of the curved hand.

15. The pitching machine of claim 14, wherein the spring is configured to return the throwing arm to a starting position after discharge of a softball from the pitching machine.

16. A method of hitting a slow pitch softball, the method comprising the steps of providing a softball pitching machine in accordance with claim 1, discharging a softball from the softball pitching machine, the softball being discharged along an arcuate path with a forward spin, and swinging a bat into contact with the softball after the softball has reached an apex of the arcuate path.

17. The method of claim 16, wherein the softball pitching machine includes a home-plate remote user input shaped to lie over or in place of a home plate, and wherein the method includes discharging the softball from the softball pitching machine in response to tapping or stepping onto the home-plate remote user input.

18. The pitching machine of claim 17, wherein the ball rail includes ball support rods that are spaced apart to allow the curved hand to pass through the space during movement of the throwing arm along the predetermined arcuate path.

19. A softball pitching machine for lobbing softballs to a batter, the pitching machine comprising a base adapted to engage ground underlying the pitching machine, a ball ramp assembly supported above the ground by the base that stores and presents softballs to be discharged from the pitching machine, and a ball launcher configured to lob softballs presented on the ball ramp assembly along an arcing path with a forward spin mimicking the spin of a softball pitched underhand by a human pitcher to a batter, the ball launcher including a throwing arm having an extension and a curved hand, wherein the ball ramp assembly includes a ball rail configured to support a single softball in position for the curved hand of the throwing arm to engage and discharge the softball from the pitching machine during movement of the throwing arm along the predetermined arcuate path, wherein the ball ramp assembly includes a hopper configured to store a plurality softballs prior to discharge from the softball pitching machine wherein the ball ramp assembly includes a ball gate configured to selectively allow a softball to pass from the hopper to the ball rail for engagement by the ball launcher, wherein the ball gate is configured to be moved from a normally closed position to an opened position allowing a softball to pass from the hopper to the ball rail for engagement by the ball launcher in response to receipt of a signal from a remote user input, and wherein the remote user input is a home-plate remote user input shaped to lie over or in place of a home plate and has sensors configured to detect a bat tap or step onto a home plate for initiating a ball launch sequence.

20. The pitching machine of claim 19, wherein the ball ramp assembly includes a ball rail configured to support a single softball in position for the curved hand of the throwing arm to engage and discharge the softball from the pitching machine.

* * * * *